US010213632B2

(12) United States Patent
Gooder

(10) Patent No.: US 10,213,632 B2
(45) Date of Patent: Feb. 26, 2019

(54) SAFETY ANCHOR

(71) Applicant: QBM Distributors Limited, Leeds (GB)

(72) Inventor: James Gooder, Leeds (GB)

(73) Assignee: QBM DISTRIBUTORS LIMITED, Leeds (GB)

( * ) Notice: Subject to any disclaimer, the term of this patent is extended or adjusted under 35 U.S.C. 154(b) by 0 days.

(21) Appl. No.: 15/418,608

(22) Filed: Jan. 27, 2017

(65) Prior Publication Data

US 2017/0216636 A1 Aug. 3, 2017

(30) Foreign Application Priority Data

Jan. 29, 2016 (GB) ..... 1601680.0

(51) Int. Cl.
*A62B 35/04* (2006.01)
*E04G 21/32* (2006.01)
*A62B 35/00* (2006.01)

(52) U.S. Cl.
CPC ..... *A62B 35/04* (2013.01); *A62B 35/0068* (2013.01); *E04G 21/3276* (2013.01)

(58) Field of Classification Search
CPC ..... A62B 35/04; A62B 35/0068
USPC ..... 248/237, 548, 636, 231.9; 185/100, 112, 185/113, 231, 3, 4, 5, 6, 9, 36; 182/100, 182/112, 113, 231, 3, 4, 5, 6, 9, 36
See application file for complete search history.

(56) References Cited

U.S. PATENT DOCUMENTS 4,238,096 A * 12/1980 Dvorachek ..... F16L 3/16 248/160
7,927,052 B1 * 4/2011 Varden ..... F16B 39/108 411/197
2003/0151180 A1 * 8/2003 Renton ..... A62B 35/04 267/155
2012/0267194 A1 * 10/2012 Jones ..... A62B 35/0087 182/100
2014/0001334 A1 * 1/2014 Hirst ..... A62B 35/0068 248/560
2017/0216636 A1 * 8/2017 Gooder ..... A62B 35/0068
2017/0247894 A1 * 8/2017 Sargent ..... A62B 35/0068

FOREIGN PATENT DOCUMENTS

EP 2317029 A2 5/2011
GB 2496008 A 6/2002
WO 2012 130597 A1 10/2012

* cited by examiner

*Primary Examiner* — Muhammad Ijaz
(74) *Attorney, Agent, or Firm* — Craft Chu PLLC; Andrew W. Chu

(57) ABSTRACT

The safety anchor includes a base, which is fixable to a roof structure; an absorber, which is attached to the base; and a housing, which houses the absorber. A clamping member is provided within the housing for clamping the housing against the base.

15 Claims, 3 Drawing Sheets

SAFETY ANCHOR

CROSS-REFERENCE TO RELATED APPLICATIONS

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present disclosure relates to a safety anchor. In particular to a safety anchor suitable for use in a fall arrest system mountable on a rooftop, or similar, to protect a user against a fall from height.

2. Description of Related Art Including Information Disclosed Under 37 CFR 1.97 and 37 CFR 1.98.

Fall arrest systems are well known, they are commonly found on rooftops and typically comprise a plurality of safety anchors that together support a tensioned cable to which a user worn harness may be attached. Once connected to the tensioned cable, the user is safe to move around the rooftop. In the event of a fall, the roof anchors deploy to absorb the fall energy of the user (or users where multiple users are connected).

Alternative fall arrest systems may comprise one or more separate safety anchors that are not linked by a tensioned cable.

There are problems with existing arrangements. The integrity of the safety anchors must generally be tested each year. Prior art safety anchors are not always resistant to the forces applied during testing. They can become damaged and require replacement. Furthermore, in systems comprising a tensioned cable, the tension of the cable can cause casings of the safety anchors to lean. Whilst this generally does not impact the integrity of the safety anchors, it can cause nervousness among users.

BRIEF SUMMARY OF THE INVENTION

According it is an object to provide an improved safety anchor, which overcomes the deficiencies of the prior art.

According to a first aspect, there is provided a safety anchor comprising: a base, which is fixable to a roof structure; an absorber, which is attached to the base; and a housing, which houses the absorber, wherein a clamping member is provided within the housing for clamping the housing against the base.

The clamping member preferably presses against a portion of the housing that is located proximal the base.

The housing preferably comprises a casing, which encloses the absorber, and at least one housing locking member, which is provided within the casing, wherein the clamping member presses against the at least one housing locking member. The housing locking member is preferably fixed to the casing. The housing locking member may comprise a locking ring. The locking ring may comprise a portion that is pressed by the clamping member and a portion that is attached to the casing.

The clamping member may comprise a reduced strength portion that is arranged to deform or fracture upon application of a predetermined load to the safety anchor. For example, the clamping member may comprise a plurality of radially extending tabs, which define the reduced strength portion. The reduced strength portion, whatever form it takes, may press against the housing locking member.

The clamping member may be attached to the base.

The clamping member may be mounted on the absorber. An absorber locking member may be mounted to the absorber, and the absorber locking member may engage the clamping member. The absorber locking member may threadably engage the absorber.

The absorber preferably extends through an opening in the base and an absorber fixing means is preferably provided on an opposed side of the base to the housing for securing the absorber to the base. The absorber fixing means may engage the base and pull the absorber through the opening. The absorber fixing means may comprise a nut that threadably engages the absorber.

The housing may comprise a reduced strength portion that is arranged to deform or fracture upon application of a predetermined load to the safety anchor. The at least one housing locking member may define the reduced strength portion.

The absorber preferably extends between a first end portion that is attached to the base and a second end portion that is attached to the housing, the safety anchor preferably has a primary axis, and the absorber preferably has a central portion that is provided between the first and second end portions and extends along an absorber axis that lies at an oblique angle to the primary axis.

The end portions of the absorber preferably extend along the primary axis. The central portion is preferably helical. The absorber axis preferably lies at an angle of between 15 and 60 degrees to the primary axis, more preferably at an angle of between 30 and 45 degrees, and most preferably at an angle of substantially 30 degrees to the primary axis.

According to a further aspect, there is provided a safety anchor comprising: a base, which is fixable to a roof structure; an absorber; and a housing, which houses the absorber, wherein the absorber extends between a first end portion that is attached to the base and a second end portion that is attached to the housing, the safety anchor has a primary axis, and the absorber has a central portion that is provided between the first and second end portions and extends along an absorber axis that lies at an oblique angle to the primary axis.

The end portions of the absorber preferably extend along the primary axis. The central portion is preferably helical. The absorber axis preferably lies at an angle of between 15 and 60 degrees to the primary axis, more preferably at an angle of between 30 and 45 degrees, and most preferably at an angle of substantially 30 degrees to the primary axis.

According to a yet further aspect, there is provided a safety anchor comprising: a base, which is fixable to a roof structure; an absorber, which is attached to the base; and a housing, which houses the absorber, wherein a clamping member is provided within the housing for clamping the housing against the base, the clamping member pressing against a portion of the housing that is located proximal the base, and the clamping member comprising a reduced strength portion that is arranged to deform or fracture upon application of a predetermined load to the safety anchor.

According to a yet still further aspect, there is provided a safety anchor comprising: a base, which is fixable to a roof structure; an absorber, which is attached to the base; and a housing, which houses the absorber, wherein a clamping member is provided within the housing for clamping the housing against the base, and wherein the housing comprises a casing, which encloses the absorber, and at least one housing locking member, which is provided within and fixed to the casing, wherein the clamping member presses against the at least one housing locking member.

BRIEF DESCRIPTION OF THE SEVERAL VIEWS OF THE DRAWINGS

An exemplary arrangement will now be described with reference to the accompanying drawings.

DETAILED DESCRIPTION OF THE INVENTION

Figure 1:
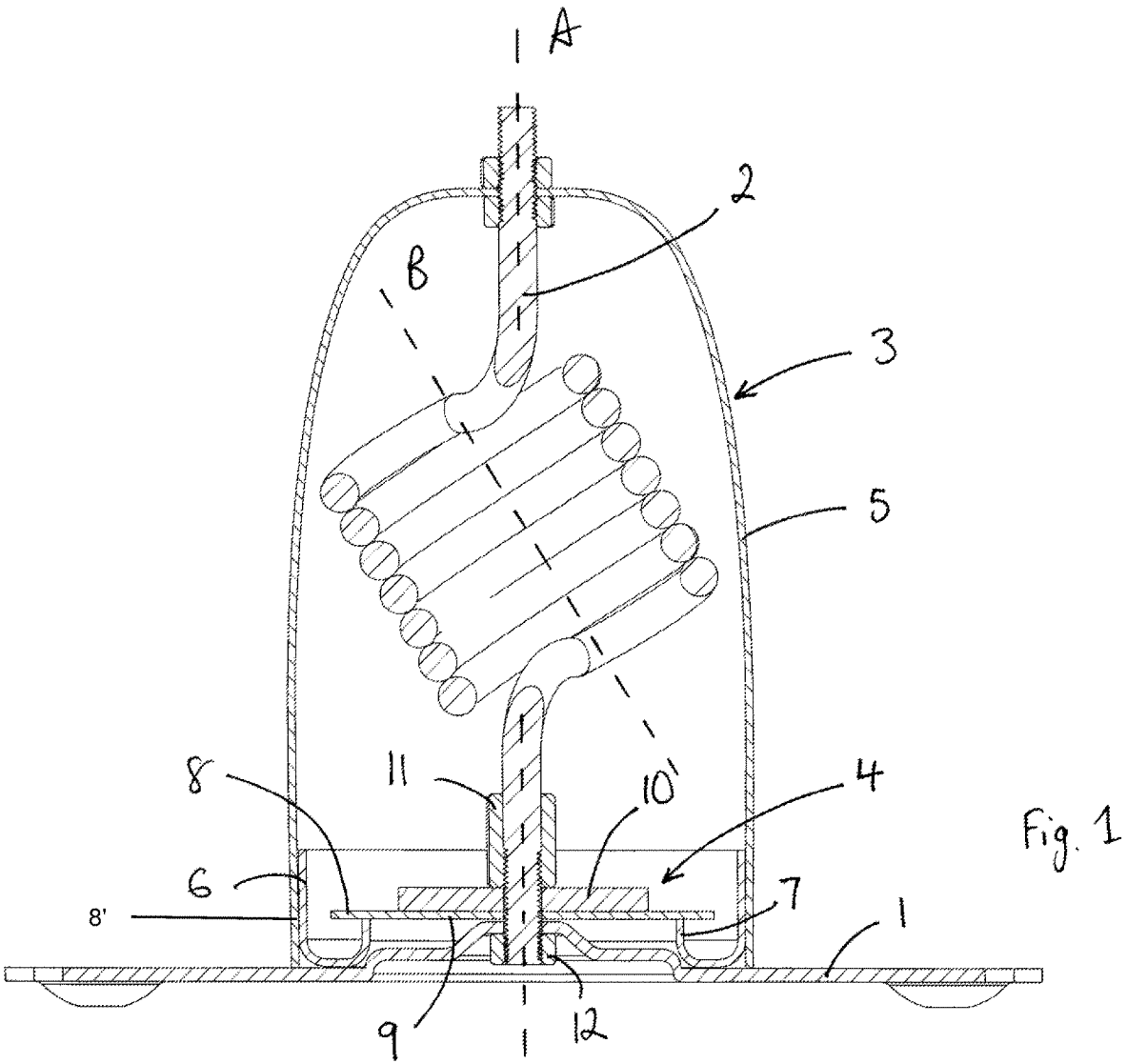
FIG. 1 shows a sectional side view of a safety anchor according to an embodiment of the present invention, prior to activation.
Figure 2:
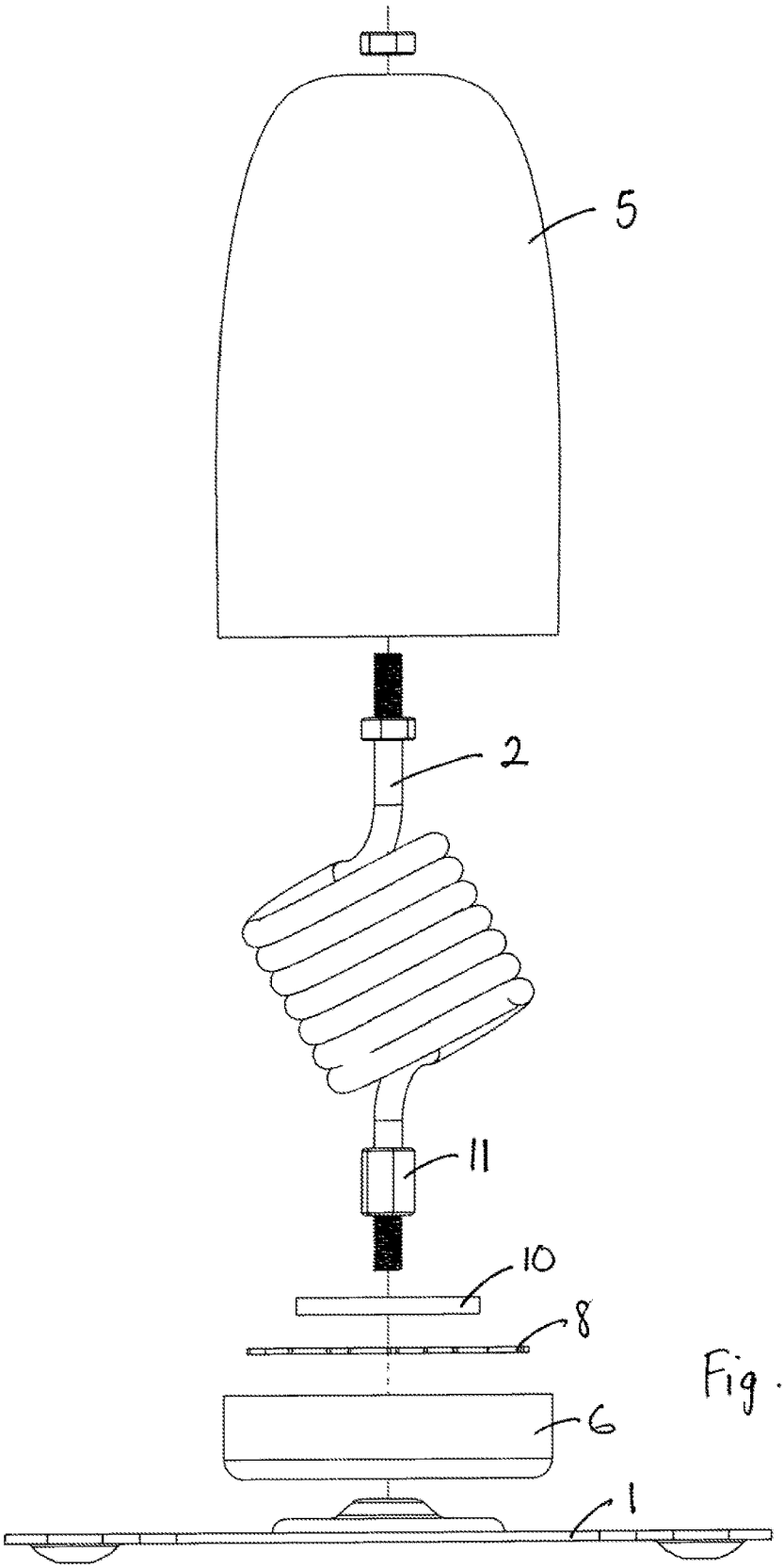
FIG. 2 shows an exploded side view of the safety anchor of FIG. 1.
Figure 3:
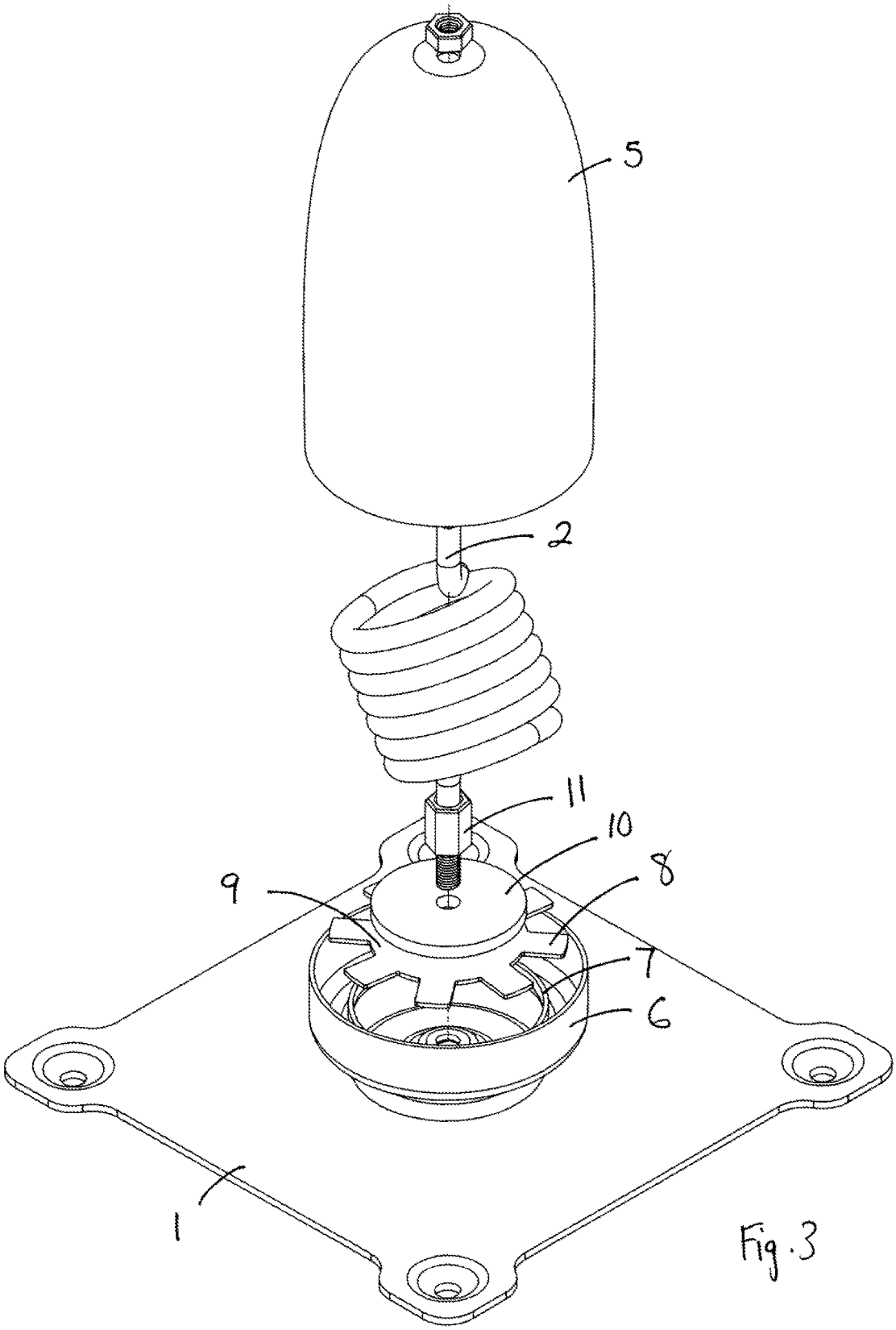
FIG. 3 shows an exploded perspective view of the safety anchor of FIG. 1.

The safety anchor comprises, in broad terms, a base 1, which is fixable to a roof structure (not shown), an absorber 2, which is attached to the base 1, a housing 3, which houses the absorber 2, and a clamping member 4, which is provided within the housing 3 for clamping the housing 3 against the base 1.

By clamping the housing to the base, external forces (below a predetermined level, as discussed below) are prevented from acting upon the absorber. The safety anchor may effectively resist forces applied during testing to maintain integrity. Moreover, where a tensioned cable is attached to the safety anchor, a lateral force applied to the safety anchor by the cable, which may otherwise cause the safety anchor to tip by a bending of the absorber, is resisted and the housing (and safety anchor as a whole) remains in a desired orientation to the base (i.e. substantially perpendicular) with weather sealing ensured.

Activation of the safety anchor may only occur upon the application of a predetermined external force to the safety anchor. Such activation requires the release of the housing from the clamping means. As discussed below, this may occur by the deformation or fracturing of the clamping member or, alternatively or additionally, by the deformation or fracturing of the housing. As will be readily appreciated by those skilled in the art, in dependence on the specific arrangement, the relevant component parts may be engineered to have a suitable deformation or fracturing load resistance.

The clamping member 4 may be mounted on the absorber 2, as shown. By such arrangement the clamping member 4 may be considered to be attached or fixed to the base 1 via the absorber 2. The absorber 2 will press the clamping member 4 against the housing 3 to thereby clamp the housing 3 against the base 1.

The housing 3 preferably comprises a casing 5, which encloses the absorber 2, and at least one housing locking member 6, which is provided within and fixed to the casing. In such an arrangement, the clamping member 4 will press against the at least one housing locking member. The housing locking member may be fixed to the casing 5 in any suitable manner. It is most preferably welded, although other mechanical fastening means may be used as will be appreciated by those skilled in the art. Whilst in the present arrangement, for ease of construction/assembly, the housing locking member 6 is formed separately to the casing 5, in alternative arrangements these elements could be unitarily formed.

The housing locking member 6 may comprises a locking ring 7, as shown. It is preferably annular in form. It may, however, take other forms in dependence on the shape of the casing. The locking ring 7 preferably extends continuously around the internal periphery of the casing to be joined thereto. The locking ring 7 may comprise a lip that is upturned away from the base 1 to be pressed by the clamping member 4, as shown. By such arrangement, the locking ring 7 may have a substantially U-shaped sectional profile at its base. It may have a curved or straight profile. The locking ring 7 may take any form provided that it has suitable rigidity for resisting the pressing force applied by the clamping member without significant deformation. An arrangement with an upturned lip is preferred, since it offers beneficial weather sealing properties. An alternative preferred arrangement comprises a stepped ring, which comprises a substantially L-shaped profile. Such a ring will operate in the manner of the depicted locking ring but may be machined for ease of manufacture. Numerous alternative ring profiles will be possible.

The clamping member 4 in the depicted arrangement comprises a reduced strength portion 8 that is arranged to deform or fracture upon application of a predetermined load to the safety anchor. The reduced strength portion 8 may be defined by a plurality of radially extending tabs, as shown. The safety anchor is activated by the deformation (or fracture) of the reduced strength portion 8, which is engineered to have a reduced strength to the remainder of the clamping member 4. Whilst in the depicted arrangement the clamping member 4 is provided with a central high strength portion and a peripheral reduced strength portion, which presses against the housing locking member, clearly these areas may be reversed or otherwise arranged. Moreover, whilst the reduced strength portion is defined by radial tabs it could instead be formed by a ring or by a weakened joint between the high strength and reduced strength portions, or otherwise. In the present arrangement, the clamping member comprises a planar element 9, which may comprise a disc as shown, and a reinforcing member 10, which again may comprise a disc, as shown. Here the reinforcing member 10 has an increased thickness (and strength) to the planar element 9 and covers (and thereby defines the limits of) the high strength portion. Of course in alternative arrangements, the reinforcing member may be omitted with the planar element 9 replaced with an element provided with reinforcing ribs or being otherwise formed to define the high strength and low strength portions.

In the present arrangement, the clamping member 4 comprises a through hole. A first end portion of the absorber 2 extends through the through hole in the clamping member 4. The first end portion of the absorber 2 is threaded and is provided with an absorber locking member 11 that is threadably engaged therewith and is larger than the through hole in the clamping member, such that it may apply a pressing force to an upper surface of the clamping member 4. The absorber locking member 11 may comprise a collar. As may be seen, it preferably comprises a non-threaded portion that extends along and supports a portion of the absorber. Such feature offers additional support to the absorber 2. The absorber locking member 11 may, however, take alternative forms. Moreover, in alternative arrangements the absorber locking member 11 may be omitted, with the absorber shaped to apply a pressing force to the clamping member 4 directly or the clamping member 4 being otherwise fixed to the base 1.

In the present arrangement, a first end portion of the absorber 2 extends through an opening in the base and an absorber fixing means 12 is provided on an opposed side of the base to the housing for securing the absorber to the base. The absorber fixing means 12 preferably comprises a nut that threadably engages the absorber 2. By tightening the nut, the absorber is pulled down through the opening, which in turn applies a pressing force to the clamping member 4 for clamping the housing 3 against the base 1.

Whilst in the depicted arrangement, the clamping means is mounted on the absorber (and as mentioned may be considered to be attached or fixed to the base plate via the absorber), in alternative arrangements the clamping member may not be provided on the absorber. The clamping member 4 could instead be attached or fixed to the base 1 independently of the absorber. For example, one or more bolts could engage the clamping member and extend through the base with nuts provided on the underside of the base for pulling the clamping member 4 down to clamp the housing 3 against the base 1. Various alternative arrangements will be readily conceived by those skilled in the art. Moreover, whilst a single clamping member is provided in the disclosed arrangement a plurality of separate clamping members may be provided instead. The same applies to the suggested alternative arrangements.

Irrespective of the specific arrangement of the clamping member 4 it is preferred that a portion of the housing 3 is sandwiched between the clamping member 4 and the base 1. The clamping member most preferably directly engages a portion of the housing 3.

As mentioned above, instead of (or in addition to) the clamping member 4 defining the reduced strength portion 8 that is arranged to deform or fracture upon application of a predetermined load to the safety anchor, the housing 3 may instead define the reduced strength portion of the housing 8'. The housing locking member 6 could define the reduced strength portion. The reduced strength portion of the housing 8' could be implemented by controlling the breaking point of the joint or fixing means between the housing locking member 6 and the casing 5. Alternatively, the housing locking member 6 could comprise a plurality of deformable tabs, a deformable ring, a weakened joint between high strength and reduced strength portions thereof, or similar (whether formed integrally or separately to the casing). Numerous arrangements will be readily conceived by those skilled in the art.

In the depicted arrangement, the absorber 2 extends between the first end portion that is attached to the base (as discussed above) and a second end portion that is attached to the housing. The safety anchor has a primary axis A, which prior to activation of the safety anchor is preferably substantially perpendicular to the base 1, as shown. The absorber 2 has a central portion that is provided between the first and second end portions and extends along an absorber axis B that lies at an oblique angle to the primary axis A. The end portions of the absorber 2 preferably extend along the primary axis A, as shown. The central portion is preferably helical, as shown. The absorber axis B may lie at an angle of between 15 and 60 degrees to the primary axis, more preferably at an angle of between 30 and 45 degrees, and most preferably at an angle of substantially 30 degrees. A fastening means (not shown) for safety equipment or a tensioned cable is fixed to the second end portion of the absorber 2. Upon activation a majority of the force acts substantially perpendicular to the absorber axis A, i.e. perpendicular to the axis of the second end portion of the absorber 2. By providing the absorber central portion an oblique angle, leaning in the activation direction (i.e. towards the edge of a roof when the anchor is part of a fall arrest system on a roof), the safety anchor may activate more quickly/efficiently.

It should be noted that arrangements that omit the clamping member 4 but include the oblique central portion of the absorber 2, as discussed in the preceding paragraph, form part of the present disclosure. Moreover, arrangements provided with the clamping member 4 may use alternative absorber means that omit the oblique central portion.

The second end portion of the absorber 2 extends through an opening at the top of the casing 5. The casing is preferably fixed to the absorber. It may be fixed to the absorber by a pair of nuts, as shown. Clearly numerous alternative fixing means may be used.

The safety anchor is preferably weather sealed, so that no moisture ingress is possible through any opening in the base. The clamping of the housing to the base aids in this weather sealing. The casing 5 may be considered to take the form of an upturned cup or can and may take various forms, as will be appreciated by those skilled in the art. Its walls are closed. The base 1 may take any conventional form that allows its sealable fixing to a roof or other structure.

In use, when an activation force is applied to the second end portion of the absorber 2, which is sufficient to deform or fracture the reduced strength portion(s), the housing will be released from the base and the central portion of the absorber will unfurl or otherwise expand to arrest the fall of a user in a controlled manner. The housing will remain attached to the absorber by virtue of the fixing means at its second end portion. The activation force may be set at any predetermined value. It may be a force of 1.5 kN or greater.

Whilst a number of exemplary embodiments have been detailed above, those skilled in the art will appreciate that numerous modifications may be made to those embodiments, without departing from the scope of the claims that follow.

I claim:

1. A safety anchor, comprising:

a base, being fixable to a roof structure;

an absorber, being comprised of a first end portion, a second end portion, and a central portion between said first end portion and said second end portion;

a housing having a primary axis and containing said absorber within said housing; and an absorber fixing means on an opposed side of said base to said housing so as to secure said absorber to said base, wherein said first end portion attaches to said base, wherein said second end portion attaches to said housing, wherein said central portion is comprised of a helix with an absorber axis, said absorber axis being at an oblique angle to said primary axis, and wherein said first end portion of said absorber extends through an opening in said base along said primary axis.

2. A The safety anchor, as claimed in claim 1, further comprising:

a clamping member being within said housing and clamping said housing against said base, wherein said clamping member presses against a portion of said housing being located proximal to said base, said clamping member being comprised of a reduced strength clamping member portion being deformed or fractured upon application of a predetermined load, and wherein said absorber extends through an opening in said base.

3. The safety anchor as claimed in claim 2, wherein said housing comprises:

a casing; and a housing locking member, being provided within said casing, wherein said clamping member presses against said housing locking member.

4. The safety anchor as claimed in claim 3, wherein said reduced strength clamping member portion presses against said housing locking member.

5. The safety anchor as claimed in claim 3, wherein said housing locking member comprises a locking ring.

6. The safety member as claimed in claim 5, wherein said locking ring comprises a portion pressed by said clamping member and another portion attached to said casing.

7. The safety anchor as claimed in claim 2, wherein said reduced strength clamping member portion comprises a plurality of radially extending tabs.

8. The safety anchor as claimed in claim 2, wherein said clamping member is attached to said base.

9. The safety anchor as claimed in claim 2, wherein said clamping member is mounted on said absorber.

10. The safety anchor as claimed in claim 9, further comprising: an absorber locking member being mounted to said absorber and engaging said clamping member.

11. The safety anchor as claimed in claim 2, wherein said absorber fixing means engages said base and pulls said absorber through said opening.

12. The safety anchor as claimed in claim 1, wherein said absorber fixing means comprises a nut threadably engaging said absorber.

13. The safety anchor as claimed in claim 2, wherein said housing comprises an additional reduced strength housing portion, being deformed or fractured upon application of an additional predetermined load corresponding to said housing.

14. The safety anchor, as claimed in claim 1, wherein said oblique angle is between 15 and 45 degrees relative to said primary axis.

15. A safety anchor comprising:

a base, being fixable to a roof structure;

an absorber being attached to said base;

a housing, said absorber being contained within said housing;

a clamping member being within said housing and clamping said housing against said base, wherein said clamping member presses against a portion of said housing being located proximal to said base, said clamping member being comprised of a reduced strength clamping member portion being deformed or fractured upon application of a predetermined load, and wherein said absorber extends through an opening in said base;

an absorber fixing means on an opposed side of said base to said housing so as to secure said absorber to said base, wherein said clamping member is mounted on said absorber; and an absorber locking member being mounted to said absorber and engaging said clamping member, wherein said absorber locking member threadably engages said absorber.

* * * * *